US009684259B2

(12) United States Patent
Komori et al.

(10) Patent No.: US 9,684,259 B2
(45) Date of Patent: Jun. 20, 2017

(54) IMAGE FORMING APPARATUS

(71) Applicants: Takatsugu Komori, Chiba (JP); Emiko Shiraishi, Tokyo (JP); Tadashi Kasai, Kanagawa (JP); Takamasa Ozeki, Kanagawa (JP); Jun Hitosugi, Tokyo (JP); Kunio Hasegawa, Kanagawa (JP); Makoto Yasuda, Kanagawa (JP); Wakana Itoh, Tokyo (JP); Mutsuki Morinaga, Kanagawa (JP); Hitoshi Yamamoto, Kanagawa (JP)

(72) Inventors: Takatsugu Komori, Chiba (JP); Emiko Shiraishi, Tokyo (JP); Tadashi Kasai, Kanagawa (JP); Takamasa Ozeki, Kanagawa (JP); Jun Hitosugi, Tokyo (JP); Kunio Hasegawa, Kanagawa (JP); Makoto Yasuda, Kanagawa (JP); Wakana Itoh, Tokyo (JP); Mutsuki Morinaga, Kanagawa (JP); Hitoshi Yamamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/971,251

(22) Filed: Dec. 16, 2015

(65) Prior Publication Data

US 2016/0170321 A1 Jun. 16, 2016

(30) Foreign Application Priority Data

Dec. 16, 2014 (JP) ..... 2014-254053

(51) Int. Cl.
*G03G 15/00* (2006.01)
*G03G 15/01* (2006.01)

(52) U.S. Cl.
CPC ..... *G03G 15/0189* (2013.01); *G03G 15/5029* (2013.01); *G03G 15/5066* (2013.01); *G03G 15/55* (2013.01)

(58) Field of Classification Search
None
See application file for complete search history.

(56) References Cited

U.S. PATENT DOCUMENTS 5,162,853 A * 11/1992 Ito ..... G03G 15/01 399/389
7,860,411 B2 * 12/2010 Toda ..... G03G 15/5062 399/15

(Continued)

FOREIGN PATENT DOCUMENTS

JP 2002-029120 1/2002
JP 2006078883 A * 3/2006

(Continued)

*Primary Examiner* — Sevan A Aydin
(74) *Attorney, Agent, or Firm* — Oblon, McClelland, Maier & Neustadt, L.L.P.

(57) ABSTRACT

An image forming apparatus includes an image formation processor to perform image formation to a recording medium with a primary color toner and a secondary color toner that is different from the primary color toner, a database to store multiple setting values, each of which corresponding a combination of a mode type depending on the primary color toner and the secondary color toner and a media type of the recording medium and being applied to a process of the image formation performed by the image forming processor, a database retriever to retrieve an optimum setting value from the multiple setting values stored in the database according to a specified combination of the mode type and the media type, and an operation setting arranger to perform the image formation based on the optimum setting value acquired from the database retriever.

7 Claims, 4 Drawing Sheets

(56) References Cited

U.S. PATENT DOCUMENTS

| | | | | |
|---|---|---|---|---|
| 2005/0158093 | A1* | 7/2005 | Kato | G03G 15/6594 399/388 |
| 2008/0124093 | A1* | 5/2008 | Kai | G03G 15/5087 399/9 |
| 2009/0196644 | A1* | 8/2009 | Funatsu | G03G 15/5062 399/69 |
| 2010/0165398 | A1* | 7/2010 | Watanabe | H04N 1/2307 358/1.15 |
| 2011/0223527 | A1 | 9/2011 | Iio et al. | |
| 2012/0105915 | A1 | 5/2012 | Kobayashi et al. | |
| 2012/0107004 | A1 | 5/2012 | Sonohara et al. | |
| 2013/0028619 | A1 | 1/2013 | Terao et al. | |
| 2013/0028620 | A1* | 1/2013 | Terao | G03G 15/0189 399/46 |
| 2013/0089343 | A1* | 4/2013 | Nishimura | G03G 15/502 399/12 |
| 2013/0101303 | A1 | 4/2013 | Kasai et al. | |
| 2013/0342859 | A1 | 12/2013 | Kasai et al. | |
| 2015/0037049 | A1 | 2/2015 | Shiraishi et al. | |
| 2015/0050033 | A1 | 2/2015 | Kasai et al. | |
| 2015/0205237 | A1 | 7/2015 | Kasai et al. | |

FOREIGN PATENT DOCUMENTS

| | | | |
|---|---|---|---|
| JP | 2010-127988 | | 6/2010 |
| JP | 2010152209 A | * | 7/2010 |

* cited by examiner

IMAGE FORMING APPARATUS

CROSS-REFERENCE TO RELATED APPLICATIONS

This patent application is based on and claims priority pursuant to 35 U.S.C. §119(a) to Japanese Patent Application No. 2014-254053, filed on Dec. 16, 2014, in the Japan Patent Office, the entire disclosure of which is hereby incorporated by reference herein.

BACKGROUND

Technical Field

This disclosure relates to an image forming apparatus for performing image formation with special color toners in addition to regular color toners.

Related Art

Recent electrophotographic image forming apparatus employ various types of sheets applicable thereto. For example, various types of sheets include special paper such as transparent sheet, sheet having an uneven surface, color paper, and synthetic (waterproof) paper in addition to regular paper such as "plain paper", "thick paper", and "coated paper". To utilize these special papers for image formation, new products including mechanisms and parts different from conventional mechanisms and parts to a fixing unit and a transfer unit are introduced and launched onto the market in response to customer's demands.

Some recently developed image forming apparatuses use special color toner(s) in addition to regular color toners, which are yellow (Y), magenta (M), cyan (C), and black (K) toners. The special color toner includes clear toner (such as transparent toner, colorless toner, achromatic color toner, and no pigment toner) and white toner. The clear toner is supplied over the whole or part surface of a printed medium on which a color image is formed, is adjusted by gross control, so that a high value-added print is generated. The white toner functions as a background of a color image with the cyan, magenta, yellow, and black color toners to be printed on a dark colored paper and a transparent medium.

The above-described image forming apparatuses include four image forming stations for forming respective regular color toner images, i.e., yellow, magenta, cyan, and black color toner images. In addition to these image forming stations, the image forming apparatuses further include another image forming station for forming special color toner images or any one of the regular color toners provided to the respective image forming stations can be replaced with the special color toner.

For example, in order to prevent human errors in setting a printing mode and to provide good quality of printing, known image forming apparatuses include a transmitter to transmit information of type of a printing medium inputted by a user or uses to a database server via a communication network and a receiver to receive the information transmitted by the transmitter. The image forming apparatuses control the image forming operations to be performed in an optimum printing mode selected based on the information received from the data base server by the receiver.

In order to meet customer's demands of high quality printing with specific recording media, manufacturers in the production printing market have previously evaluated recording media (printing media) which are widely known on the market and have distributed the results of evaluation provided in an image forming apparatus in forms of a list or a table of optimized recording media setting database including recommended setting values of the recording media. Consequently, if a user selects data of a printing medium to be used from the setting database table when initiating a print job, an optimum printing quality can be achieved without any consideration and knowledge of operations. Specifically, each of the setting database lists proves data of recording media such that a single brand of a printing medium meets a single optimum print setting of the printing medium.

However, due to an increase in types of toners, these setting values of the setting database list do not achieve the optimum printing quality. For example, in a case in which clear toner is superimposed on a toner image including the cyan, magenta, yellow, and black color toners, an amount of toner on the printing medium increases by the amount of clear toner when compared with the printing medium without the clear toner thereon. To prevent this inconvenience, a fixing temperature, a speed of conveyance of the printing medium, and a transfer current are adjusted. Specifically, an image forming apparatus in which multiple types of special color toners are replaceable in image forming operations is provided with optimum setting values equal to the number of special color toners that are available to a single specific printing medium.

As described above, a single setting data has been sufficient to each printing medium in an image forming apparatus without special color toner(s), which is no longer sufficient when the image forming apparatus includes special color toner(s). Specifically, it is likely that the image forming apparatus using special color toner(s) is prepared and provided with the number of setting data equally corresponding to the number of estimated various ways of printing each printing medium. Therefore, when the image forming apparatus is used, the setting data is changed according to the printing medium to be used and the printing mode, and the settings are complicated and time consuming.

SUMMARY

At least one aspect of this disclosure provides an image forming apparatus that includes an image formation processor to perform image formation to a recording medium with a primary color toner and a secondary color toner that is different from the primary color toner, a database to store multiple setting values, each of which corresponding to a combination of a mode type depending on the primary color toner and the secondary color toner and a media type of the recording medium and being applied to a process of the image formation performed by the image formation processor, a database retriever to retrieve an optimum setting value from the multiple setting values stored in the database according to a specified combination of the mode type and the media type, and an operation setting arranger to perform the image formation based on the optimum setting value acquired from the database retriever.

DETAILED DESCRIPTION

Figure 1:
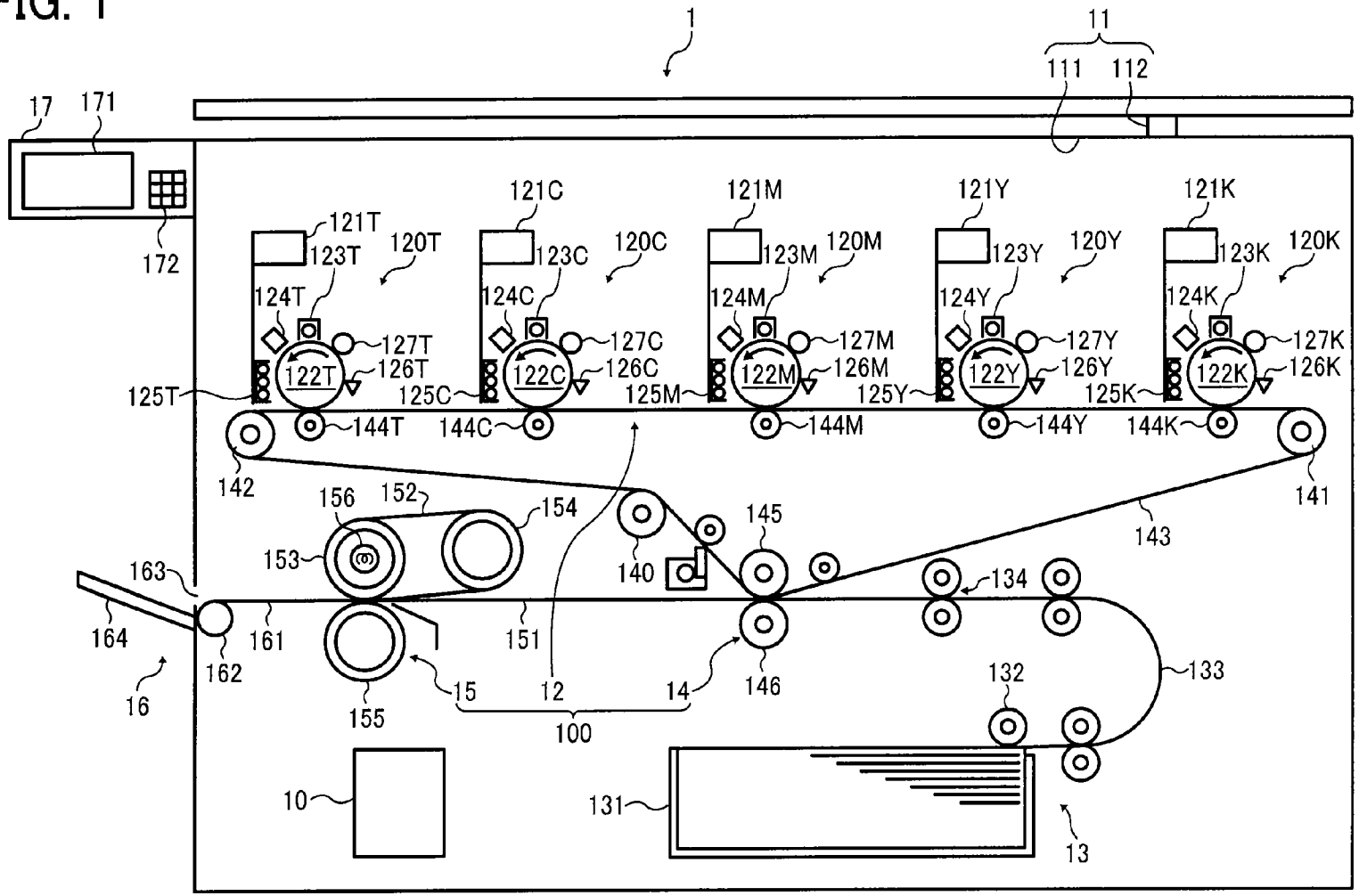
FIG. 1 is a cross sectional view illustrating a configuration of an image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Figure 2:
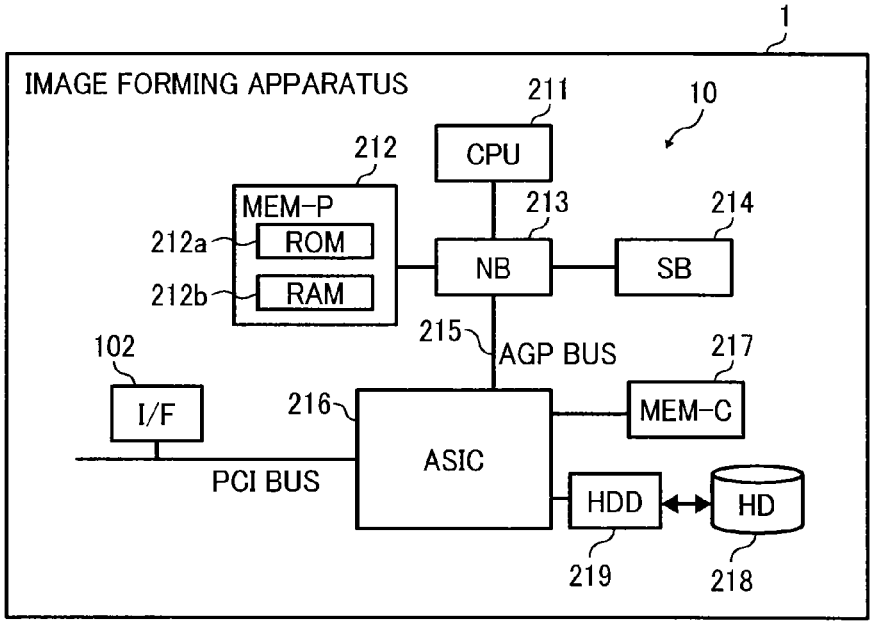
FIG. 2 is a block diagram of a hardware configuration of a controller of the image forming apparatus of FIG. 1.

Now, a description is given of an image forming apparatus 1 according to an example of this disclosure with respect to FIGS. 1 and 2.

FIG. 1 is a cross sectional view illustrating a configuration of the image forming apparatus 1 according to an example of this disclosure. FIG. 2 is a block diagram of a hardware configuration of a controller 10 of the image forming apparatus 1 of FIG. 1.

It is to be noted that identical parts are given identical reference numerals and redundant descriptions are summarized or omitted accordingly.

The image forming apparatus 1 may be a copier, a facsimile machine, a printer, a multifunction peripheral or a multifunction printer (MFP) having at least one of copying, printing, scanning, facsimile, and plotter functions, or the like. According to the present embodiment, the image forming apparatus 1 is an electrophotographic color copier that forms color and monochrome toner images on recording media by electrophotography.

It is to be noted in the following examples that: the term "image forming apparatus" indicates an apparatus in which an image is formed on a recording medium such as paper, OHP (overhead projector) transparencies, OHP film sheet P, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

The image forming apparatus 1 prints color images by fixing a toner image to a sheet that functions as a recording medium and forming the toner image on the sheet. The image forming apparatus 1 includes the controller 10, an image reading device 11, an image forming device 12, a sheet feeding device 13, a transfer device 14, a fixing device 15, a sheet discharging device 16, and a display control unit 17. The image forming apparatus 1 according to an example of this disclosure can form images with color toners used for color printing and special color toner that is different from the color toners. The image forming device 12, the transfer device 14, and the fixing device 15 form an image formation processor 100 to perform various image formation. The image formation processor 100 perform image formation to the sheet based on setting values of speed, temperature, and so forth specified by the controller 10.

As illustrated in FIG. 2, the controller 10 includes a central processing unit (CPU) 211, a main memory (MEM-P) 212, a north bridge (NB) 213, a south bridge (SB) 214, an accelerated graphics port (AGP) bus 215, an application specific integrated circuit (ASIC) 216, a local memory (MEME-C) 217, a hard disk (HD) 218, a hard disk drive (HDD) 219, and a network interface (network I/F) 102.

Based on a program/programs stored in the main memory 212, the CPU 211 processes and calculates data and controls operations of the image reading device 11, the image forming device 12, the sheet feeding device 13, the transfer device 14, the fixing device 15, and the sheet discharging device 16.

The main memory 212 is a memory of the controller 10 and includes a read-only memory (ROM) 212*a* and a random access memory (RAM) 212*b*.

The ROM 212*a* stores a program and data to perform functions performed by the controller 10. The program stored in the ROM 212*a* is an installable file or an executable file. Instead of the file format, the program can be provided in a storable medium that can be read by a computer, for example, a compact disc read only memory (CD-ROM), a floppy disk (FD), a compact disc recordable (CD-R), a digital versatile disc (DVD), and the like.

The RAM 212*b* is used as a graphic memory for processing the program and data and performing memory print.

The NB 213 connects the CPU 211 with the MEM-P 212, the SB 214, and the AGP bus 215.

The SB 214 connects the NB 213 with the PCI device and peripheral devices.

The AGP bus 215 is a bus interface for a graphics accelerator card to increase a speed in graphic processing.

The ASIC 216 includes multiple direct memory access controllers (DMACs) that rotate image data by a PCI target and an AGP master, an arbiter (ARB), a memory controller, and hardware logic. The ARB functions as a core of the ASIC 216. The memory controller controls the MEM-C 217. The ASIC 216 is connected to an interface of a universal serial bus (USB) and an interface of an Institute of Electrical and Electronics Engineers 1394 (IEEE1394) via a PCI BUS.

The MEM-C 217 is a local memory used as a copy image buffer and a code buffer. The HD 218 is a storage used to store image data, font data used for printing, and forms. The HDD 219 controls data reading and data writing with respect to the HD 218 following instructions issued by the CPU 211. The network I/F 102 performs data transmission with respect to external devise such as data processing devices via a communication network.

The image reading device 11 is a scanner that optically reads an image formed on a sheet to produce image data. Specifically, the image reading device 11 emits light onto a sheet and receives the reflected light by a reading sensor such as a charge coupled device (CCD) or a contact image sensor (CIS) to output image data. It is to be noted that the term "image data" indicates data of an image to be formed on a printing medium such as a sheet. The image data is described using electrical color separation image signals of red (R), green (G), and blue (B).

As illustrated in FIG. 1, the image reading device 11 includes an exposure glass 111 and a reading sensor 112. A sheet on which image is formed is placed on the exposure glass 111. The reading sensor 112 reads image data of the sheet placed on the exposure glass 111.

The image forming device 12 forms an image, i.e., a toner image by adhering toner onto a surface of the intermediate transfer belt 143 of the transfer device 14 based on image data read by the image reading device 11 or image data received via the network I/F 102. The image forming device 12 creates respective toner images with cyan (C), magenta (M), yellow (Y), black (K), and clear (T) toners. The image forming device 12 includes an image forming unit 120C, an image forming unit 120M, an image forming unit 120Y, an image forming unit 120K, and an image forming unit 120T corresponding to the cyan (C), magenta (M), yellow (Y), black (K), and clear (T) color toners. It is to be noted that the image forming apparatus 1 can include another image forming unit corresponding to white toner in addition to the image forming units 120C, 120M, 120Y, 120K, and 120T. Alternatively, the image forming apparatus 1 can replace the image forming unit 120T with the image forming unit corresponding to white toner.

The cyan (C), magenta (M), yellow (Y), and black (K) toners are color toners, each of which is powder including resin particles having electrostatic chargeability and a colorant such as pigment and/or dye.

The clear (T) toner that corresponds to special color toner is transparent and colorless toner including resin particles, so that color toner formed on a sheet can be seen when applied over the color toner image on the sheet. Further, when the clear toner is applied on the sheet, the surface of the sheet can be seen. The clear toner is produced by adding, for example, silicon dioxide ($SiO_2$) or titanium dioxide ($TiO_2$) to polyester resin having low molecular weight. It is to be noted that the clear toner can contain colorant as long as the amount of colorant included in the clear toner does not adversely affect on visibility of the sheet or the color toner formed on the sheet.

The image forming unit 120C includes a developer container 121C, a photoconductor drum 122C, a charging device 123C, an exposure device 124C, a developing device 125C, an electrical discharging device 126C, and a cleaning device 127C.

The developer container 121C contains the cyan (C) toner to be supplied to the developing device 125C. As a conveying screw provided to the developer container 121C rotates, a given amount of the cyan color toner contained in the developer container 121C is supplied to the developing device 125C.

The surface of the photoconductor drum 122C is uniformly charged by the charging device 123C and is irradiated by the exposure device 124C to form an electrostatic latent image thereon based on the image data received from the controller 10. Then, the developing device 125C supplies the cyan color toner onto the electrostatic latent image to develop into a visible toner image. The photoconductor drum 122C is disposed in contact with the intermediate transfer belt 143 so as to rotate in the same direction as movement of the intermediate transfer belt 143 at a contact point with the intermediate transfer belt 143.

As previously described, the charging device 124C uniformly charges the surface of the photoconductor drum 122C.

The exposure device 124C emit light based on a dot area ratio of cyan determined by the controller 10 to irradiate the surface of the photoconductor drum 122C charged by the charging device 123C, so as to form an electrostatic latent image.

The developing device 125C develops the electrostatic latent image formed on the surface of the photoconductor drum 122C by the exposure device 124C into a visible toner image by supplying the cyan color toner contained in the developer container 121C.

The electrical discharging device 126C removes residual electrical charge remaining on the surface of the photoconductor drum 122C after the toner image is transferred onto the surface of the intermediate transfer belt 143.

The cleaning device 127C removes residual toner remaining on the surface of the photoconductor drum 122C after removal of residual electrical charge by the electrical discharging device 126C.

The image forming unit 120M includes a developer container 121M, a photoconductor drum 122M, a charging device 123M, an exposure device 124M, a developing device 125M, an electrical discharging device 126M, and a cleaning device 127M.

The developer container 121M contains the magenta (M) toner to be supplied to the developing device 125M.

The photoconductor drum 122M, the charging device 123M, the exposure device 124M, the developing device 125M, the electrical discharging device 126M, and the cleaning device 127M included in the image forming unit 120M have identical in functions and operations to the photoconductor drum 122C, the charging device 123C, the exposure device 124C, the developing device 125C, the electrical discharging device 126C, and the cleaning device 127C included in the image forming unit 120C, respectively.

The image forming unit 120Y includes a developer container 121Y, a photoconductor drum 122Y, a charging device 123Y, an exposure device 124Y, a developing device 125Y, an electrical discharging device 126Y, and a cleaning device 127Y.

The developer container 121Y contains the yellow (Y) toner to be supplied to the developing device 125Y.

The photoconductor drum 122Y, the charging device 123Y, the exposure device 124Y, the developing device 125Y, the electrical discharging device 126Y, and the cleaning device 127Y included in the image forming unit 120Y have identical in functions and operations to the photoconductor drum 122C, the charging device 123C, the exposure device 124C, the developing device 125C, the electrical discharging device 126C, and the cleaning device 127C included in the image forming unit 120C, respectively.

The image forming unit 120K includes a developer container 121K, a photoconductor drum 122K, a charging device 123K, an exposure device 124K, a developing device 125K, an electrical discharging device 126K, and a cleaning device 127K.

The developer container 121K contains the black (K) toner to be supplied to the developing device 125K.

The photoconductor drum 122K, the charging device 123K, the exposure device 124K, the developing device 125K, the electrical discharging device 126K, and the cleaning device 127K included in the image forming unit 120K have identical in functions and operations to the photoconductor drum 122C, the charging device 123C, the exposure device 124C, the developing device 125C, the electrical discharging device 126C, and the cleaning device 127C included in the image forming unit 120C, respectively.

The image forming unit 120T includes a developer container 121T, a photoconductor drum 122T, a charging device 123T, an exposure device 1241, a developing device 125T, an electrical discharging device 1261, and a cleaning device 127T.

The developer container 121T contains the clear (T) toner to be supplied to the developing device 125T.

The photoconductor drum 122T, the charging device 123T, the exposure device 124T, the developing device 125T, the electrical discharging device 126T, and the cleaning device 127T included in the image forming unit 120T have identical in functions and operations to the photoconductor drum 122C, the charging device 123C, the exposure device 124C, the developing device 125C, the electrical discharging device 126C, and the cleaning device 127C included in the image forming unit 120C, respectively.

The sheet feeding device 13 feeds the sheet to the transfer device 14. The sheet feeding device 13 includes a sheet container 131, a sheet feed roller 132, a sheet feeding belt 133, and a pair of registration rollers 134.

The sheet container 131 contains a bundle of sheets therein.

The sheet feed roller 132 is rotatably disposed to feed a sheet contained in the sheet container 131 and convey the sheet to the sheet feeding belt 133. The sheet feed roller 132 picks up an uppermost sheet placed on top of the bundle of sheets in the sheet container 131 and convey the sheet to the sheet feeding belt 133. In the present example, the sheet container 131 includes a single sheet tray. However, the sheet container 131 can include multiple sheet trays (for example, three sheet trays) and the sheet can be conveyed from a selected one of the sheet trays.

The sheet feeding belt 133 conveys the sheet picked up by the sheet feed roller 132 to the transfer device 14.

The pair of registration rollers 134 moves the sheet conveyed by the sheet feeding belt 133 in a downstream side of a sheet conveying direction in synchronization with a timing the toner image formed on the surface of the intermediate transfer belt 143 reaches the transfer device 14.

The transfer device 14 transfers respective single color toner images formed on the photoconductor drums 122C, 122M, 122Y, 122K, and 122T included in the image forming device 12 onto the intermediate transfer belt 143 to form a composite toner image (which is referred to as a primary transfer), and then transfers the composite toner image on the intermediate transfer belt 143 onto the sheet (which is referred to as a secondary transfer.

The transfer device 14 includes a tension roller 140, a driving roller 141, a driven roller 142, an intermediate transfer belt 143, primary transfer rollers 144C, 144M, 144Y, 144K, and 144T, a secondary transfer roller 145, and a secondary opposed roller 146.

The tension roller 140 applies tension to the intermediate transfer belt 143.

The driving roller 141 is disposed in contact with the intermediate transfer belt 143 to support and stretch together with the driven roller 142 over the intermediate transfer belt 143. As the driving roller 141 is driven to rotate, the intermediate transfer belt 143 that is stretched by the tension roller 140, the driving roller 141, and the driven roller 142 moves as a loop.

The driven roller 142 is disposed in contact with the intermediate transfer belt 143 to support and stretch together with the driving roller 141 over the intermediate transfer belt 143. The driven roller 142 is rotated with rotation of the driving roller 141 and with movement of the intermediate transfer belt 143.

The intermediate transfer belt 143 is wound around the driving roller 141 and the driven roller 142. As the driving roller 141 rotates, the intermediate transfer belt 143 moves in contact with the photoconductor drums 122C, 122M, 122Y, 122K, and 122T. Due to the movement of the intermediate transfer belt 143 while contacting the photoconductor drums 122C, 122M, 122Y, 122K, and 122T, the respective color toner images formed on the respective surfaces of the photoconductor drums 122C, 122M, 122Y, 122K, and 122T are sequentially transferred onto the surface of the intermediate transfer belt 143.

The primary transfer rollers 144C, 144M, 144Y, 144K, and 144T are disposed facing the photoconductor drums 122C, 122M, 122Y, 122K, and 122T with the intermediate transfer belt 143 interposed therebetween, and rotate so as to move the intermediate transfer belt 143.

The secondary transfer roller 145 is disposed facing the secondary opposed roller 146 with the intermediate transfer belt 143 interposed therebetween, and rotates together with the secondary opposed roller 146 while holding the intermediate transfer belt 143 and the sheet therebetween.

The secondary opposed roller 146 is disposed facing the secondary transfer roller 145 with the intermediate transfer belt 143 interposed therebetween, and rotates together with the secondary transfer roller 145 while holding the intermediate transfer belt 143 and the sheet therebetween.

The fixing device 15 fixes the toner on the toner image formed on the sheet transferred by the transfer device 14. Application of heat and pressure simultaneously to the toner can cause components of the resin particles of the toner used for forming the toner image to melt and adhere to the sheet. By fixing the toner image formed on the sheet transferred by the transfer device 14 to the sheet, the toner on the toner image is stably adhered to the sheet reliably.

The fixing device 15 includes a sheet conveying belt 151, a fixing belt 152, a fixing roller 153, a fixing belt conveying roller 154, a fixing opposed roller 155, and a heater 156.

The sheet conveying belt 151 conveys the sheet having the toner image transferred by the transfer device 14 toward the fixing roller 153 and the fixing opposed roller 155.

The fixing belt 152 is wound around the fixing roller 153 and the fixing belt conveying roller 154 and moves along with rotations of the fixing roller 153 and the fixing belt conveying roller 154.

The fixing roller 153 holds the sheet conveyed to the sheet conveying belt 151 together with the fixing opposed roller 155, so that heat and pressure is applied to the sheet held between the fixing roller 153 and the fixing opposed roller 155.

The fixing belt conveying roller 154 is disposed in contact with the fixing belt 152 to support and stretch together with the fixing roller 153 over the fixing belt 152. As the fixing belt conveying roller 154, the fixing belt 152 rotates.

The fixing opposed roller 155 is disposed facing the fixing roller 153, so as to hold the sheet conveyed to a nip region formed between the fixing opposed roller 155 and the fixing roller 153.

The heater 156 is disposed inside the fixing roller 153. The heater 156 is a heat generator to heat the sheet via the fixing roller 153.

The sheet discharging device 16 discharges the sheet having the fixed toner image thereon from the image forming apparatus 1. The sheet discharging device 16 includes a sheet discharging belt 161, a sheet discharging roller 162, a sheet discharging opening 163, and a sheet discharging tray 164.

The sheet discharging belt 161 conveys the sheet fixed by the fixing device 15 toward the sheet discharging opening 163.

The sheet discharging roller 162 discharges the sheet conveyed by the sheet discharging belt 161 via the sheet discharging opening 163 so as to stack the discharged sheet in the sheet discharging tray 164.

The sheet discharging tray 164 loads the sheet discharged by the sheet discharging roller 162.

The display control unit 17 includes a display panel 171 and a control panel 172.

The display panel 171 displays setting values and a selection window. The display panel 171 includes a touch panel to accept inputs from a user, and so forth.

The control panel 172 is a keypad including numeric keys to accept conditions related to image formation, a copy start key to accept instructions of start of a copying operation, and so forth, which are used when the user inputs instructions of image formation.

In the present example, sheets and printing modes used for image formation with the image forming apparatus 1 are set via the touch panel of the display panel 171.

A description is given of a retrieving processing performed to a sheet database in the image forming apparatus 1 according to an example of this disclosure.

Figure 3:
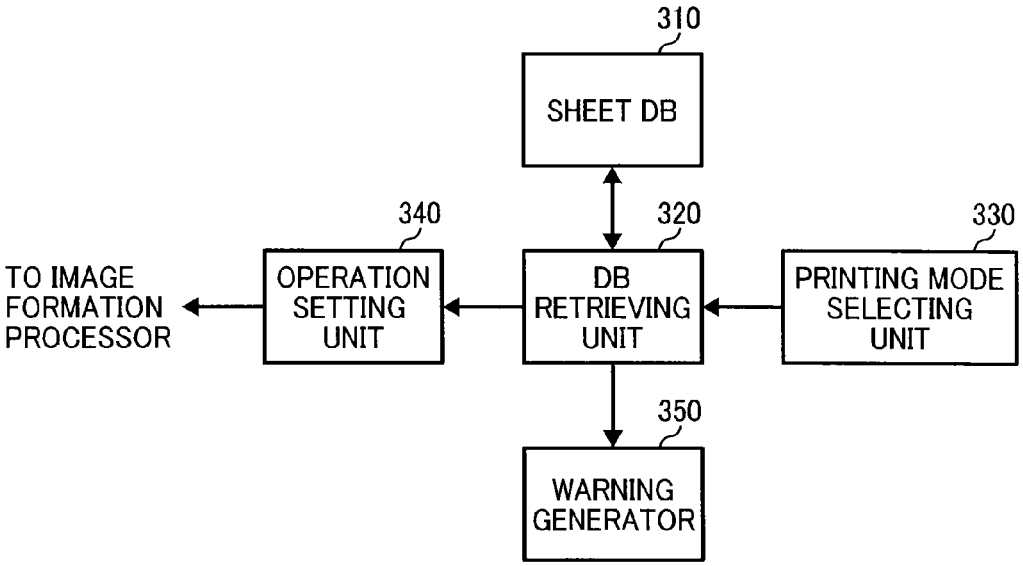
FIG. 3 is a functional block diagram of the controller of the image forming apparatus of FIG. 2.

FIG. 3 is a functional block diagram of control of the image forming apparatus 1 according to an example of this disclosure.

A manufacturer of the image forming apparatus 1 previously evaluates the printing quality of the image forming apparatus 1 to various sheet brands that are frequently used in the market and provides a list or lists of optimum setting values (recommended setting values) with respect to each of the sheet brands as a database, specifically, a sheet database 310 in the present example.

The sheet database 310 stores the list(s) containing various optimum setting values that are assumed to be used with the regular CMYK color toners and the special color toners. On receipt of user's instructions of a printing mode related to the type, brand, and special color toner for a sheet to be used, the image forming apparatus 1 makes reference to and retrieves the optimum setting value in the list(s) stored in the sheet database 310 and starts image formation based on the retrieved setting value.

Here, the sheet database 310 includes sheet brands that are guaranteed in image forming quality when using the CMYK color toners but not guaranteed when using the CMYK color toners together with the special color toner, e.g., clear toner. When a user instructs a print job with the sheet that is not guaranteed in image forming quality, the image forming apparatus 1 notifies a warning to the user. With the notification of warning, image formation under unintended conditions can be prevented.

As illustrated in FIG. 3, the image forming apparatus 1 includes the sheet database 310, a database retrieving unit 320, a printing mode selecting unit 330, an operation setting unit 340, and a warning generator 350, each of which is controlled by the controller 10 in the present example of this disclosure.

The sheet database 310 stores fixing temperatures and process linear velocities as prepared setting values for the image forming operation corresponding to multiple types of sheets and toners to be used. The sheet database 310 is constructed as reference data applicable to the HD 218.

The database retrieving unit 320 that functions as a database retriever retrieves optimum setting values for a specified printing mode. Specifically, the database retrieving unit 320 makes reference to the sheet database 310 according to the printing mode set in the printing mode selecting unit 330 and acquires the fixing temperature and the process linear velocity that are suitable to the specified printing mode.

The database retrieving unit 320 is operated by executing a program stored in the main memory 212.

The printing mode selecting unit 330 that functions as a mode selector includes the display panel 171 of the display control unit 17. The user operates the touch panel of the display panel 171 to specify the printing mode to the database retrieving unit 320.

The operation setting unit 340 that functions as an operation setting arranger causes the image forming apparatus 1 to operate based on an operation setting read by the database retrieving unit 320. The operation setting unit 340 is operated by executing a program by the CPU 211 and causes the image forming apparatus 1 to operate with the fixing temperature and the process linear velocity acquired from the sheet database 310.

The warning generator 350 that functions as a warning generator is operated by the display panel 171 of the display control unit 17.

A description is given of printing mode settings in the image forming apparatus 1 according to an example of this disclosure.

Figure 4A:
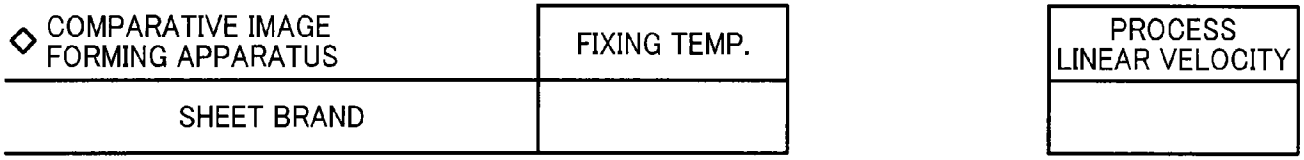
FIG. 4A is a diagram illustrating sheet settable conditions of a printing mode setting to the sheet of a comparative image forming apparatus.
Figure 4B:
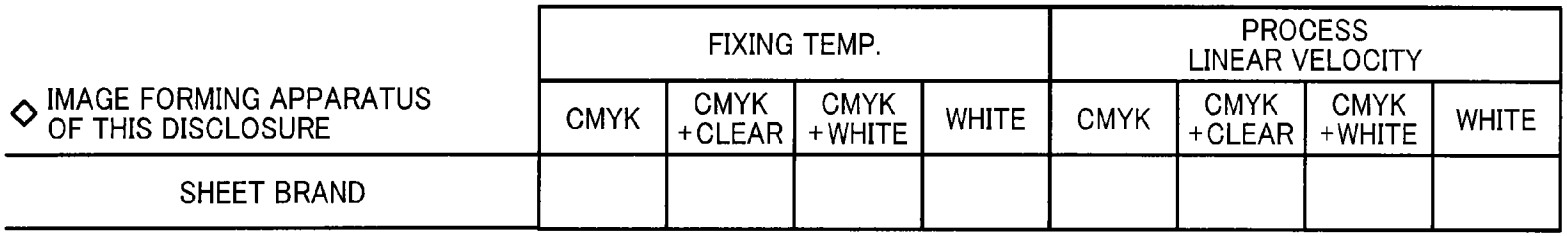
FIG. 4B is a diagram illustrating settable conditions to the sheet of the image forming apparatus according to an example of this disclosure.

FIG. 4A is a diagram illustrating settable conditions of a printing mode setting to the sheet of a comparative image forming apparatus, and FIG. 4B is a diagram illustrating settable conditions to the sheet of the image forming apparatus 1 according to the present example.

As illustrated in FIG. 4A, the comparative image forming apparatus provides a single optimum print setting (the fixing temperature and the process linear velocity) identical to the CMYK color toners to a single type of sheet.

However, as illustrated in FIG. 4B, the image forming apparatus 1 according to the present example can additionally include clear toner and white toner, and therefore includes various methods and amounts of toner formation. Consequently, the number of optimum setting values increases by the additional methods and amounts of toner formation.

The image forming apparatus 1 according to the present example includes four types of toners corresponding to a "CMYK" mode, a "CMYK+Clear" mode, a "CMYK+White" mode, and a "White" mode.

These toner combinations and corresponding sheet (recording media) types are presented in the following table as Table 1.

TABLE 1

| Sheets | Expected Combinations (Less) ← Toner Amount on Sheet → (Greater) | | | |
|---|---|---|---|---|
| (Recording Media) | White | CMYK | CMYK + Clear | CMYK + White |
| Plain Paper | Poor | Good | Good | Poor |
| OHP Sheet | Good | Good | Poor | Good |
| Black Paper | Good | Poor | Poor | Good |

The parameters in Table 1 are for any image forming apparatus in which two types of special color toners, which are clear toner and white toner, are applicable. Seven optimum setting values are provided with respect to three types of sheets (recording media). In Table 1, types of sheets as recording media are "Plain Paper", "OHP Sheet", and "Black Paper" are employed, types of toners used in the image forming apparatus are "White" for the white toner alone, "CMYK" for the cyan, magenta, yellow, and black color toners, "CMYK+Clear" for the cyan, magenta, yellow, black, and clear toners, and "CMYK+White" for the cyan, magenta, yellow, black, and white toners. Availability of these respective combinations in Table 1 is described as "Good" for any available combination and "Poor" for any non-available combination.

In the present example, the sheet database 310 includes adjusted values according to the number of toner combinations. By so doing, the setting value to be used by the operation setting unit 340 can be changed based on the results of data retrieval by the database retrieving unit 320 according to the printing mode selected by the user. Consequently, the optimum printing quality can be obtained constantly without wasting the user's time.

However, some sheet cannot be suitably applied to any printing mode. Specifically, as the amount of toner attached to the sheet increases, the drawing fixing performance and the sheet conveying performance decrease, and therefore the printing quality cannot be guaranteed.

In order to address this inconvenience, the image forming apparatus 1 according to the present example employs the settings described in Table 2 as follows. If a warning is generated and notified when any setting value that can lead to damage to the image forming apparatus 1 is retrieved, any printing operation that is not intended by the manufacturer can be prevented to be performed.

TABLE 2

| Sheets | Expected Combinations (Less) ← Toner Amount on Sheet → (Greater) | | | |
|---|---|---|---|---|
| (Recording Media) | White | CMYK | CMYK + Clear | CMYK + White |
| Plain Paper | (Note 1) | Good | Not Guaranteed | (Note 2) |
| OHP Sheet | Good | Good | (Note 2) | Not Guaranteed |
| Black Paper | Good | (Note 1) | (Note 2) | Not Guaranteed |

In Table 2, (Note 1) indicates a printing mode in which the selected sheet can be guaranteed to be used with the selected toner combination but the usage of the selected sheet together with the selected toner combination is not generally assumed, and (Note 2) indicates a printing mode in which the selected sheet cannot be guaranteed to be used with the selected toner combination and the usage of the selected sheet together with the selected toner combination is not generally assumed.

With consideration of the above-described conditions in which a non-assumable combination is included, the image forming apparatus 1 according to the present example includes the sheet database 310 having the following functions.

The sheet database 310 contains setting values of fixing temperatures and sheet linear velocity (process linear velocity) as prepared setting values of each sheet brand, in the matrix chart as illustrated in Table 3.

TABLE 3

| Sheet Brand | Mode | CMYK | CMYK + Clear | CMYK + White | White |
|---|---|---|---|---|---|
| | | Fixing Temperature | | | |
| Sheet A | 1111 | 160 | 135 | 145 | 140 |
| Sheet B | 1111 | 150 | 150 | 150 | 135 |
| Sheet C | 1111 | 155 | 155 | 155 | 140 |
| Sheet D | 1111 | 160 | 160 | 160 | 145 |
| Sheet E (Black) | 0001 | 160 | 160 | 160 | 160 |
| | | Process Linear Velocity | | | |
| Sheet A | 1111 | Regular | Low | Medium | Regular |
| Sheet B | 1111 | Regular | Low | Medium | Regular |
| Sheet C | 1111 | Regular | Low | Medium | Regular |
| Sheet D | 1111 | Regular | Low | Medium | Regular |
| Sheet E (Black) | 0001 | Low | Low | Low | Medium |

It is to be noted that, even though the matrix chart of Table 3 shows a case in which two types of toners, which are clear toner and white toner are added as special color toners, types of toners to be actually stored in the sheet database 310 are not limited thereto.

The values specified to each parameter of the sheet database 310 are the recommended values obtained based on the results of evaluation performed by the manufacturer of the image forming apparatus 1. However, it is likely, in actual image formation, to fine adjust the setting value of each processing steps performed in the image forming apparatus 1 according to user's preference. In order to comply with such user's preference, the operation setting unit 340 can set an optional setting value, that is, a setting value other than the prepared setting value obtained from the sheet database 310.

As shown in Table 3, when an image is formed on "Sheet A" in the "CMYK" printing mode, that is, when an image is formed on this type of sheet with the CMYK color toners on this type of sheet, the values of each processing step, i.e., "Fixing Temperature" and "Process Linear Velocity" are set to "160 (degrees Celsius)" and "Regular", respectively.

Further, when the printing mode is set to the "CMYK+ Clear" printing mode, "Fixing Temperature" and "Process Linear Velocity" are set to "135 (degrees Celsius)" and "Low", respectively.

For combinations of any other types of sheets and printing modes, the values in Table 3 are retrieved for setting.

Some of the sheet brands provided in the sheet database list have quality assurance limited to a specific printing mode. For example, when four types of toner combinations can be assumed as presented in Table 3, a corresponding printing mode to each sheet is stored in 4-digit codes shown in "Mode" (CMYK, CMYK+Clear, CMYK+White, and White, from the left). In the codes, "1" represents that the toner combination is applicable and "0" represents that the toner combination is not applicable. To be more specific, the quality of Sheet E, which is a black paper, is guaranteed when printed with white toner but is not guaranteed when printed with the other toner combinations.

When a user selects Sheet E (i.e., black paper) to print with the CMYK printing mode by mistake, a warning message is issued.

Figure 5:
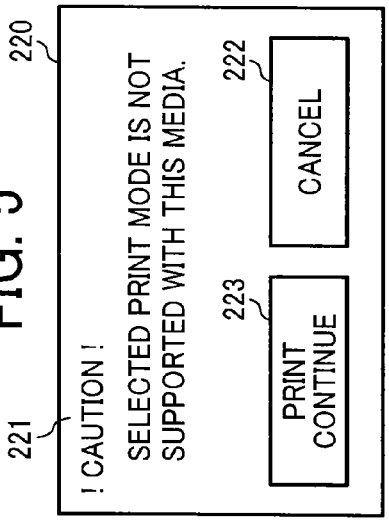
FIG. 5 is a diagram illustrating a display window displaying a warning message on the image forming apparatus of FIG. 1.

FIG. 5 is a diagram illustrating a display window displaying a warning message on the image forming apparatus 1.

As illustrated in FIG. 5, the display panel 171 of the display control unit 17 displays a warning message 221 indicated as "Caution" in a warning message window 220 to inform the warning to the user. When the user touches a cancel button 222 indicated as "Cancel", the operation stops. However, the image formation can be forcedly performed if the user touches a print continue button 223 indicated as "Print Continue".

When the print continue button 223 is pressed, even if the printing quality of the printing mode is not guaranteed, the condition of "160 (degrees Celsius)" and "Low" is retrieved, and the print job starts. This setting corresponds to the setting specified to Sheet E in the CMYK printing mode in Table 3, indicating the condition of "160 (degrees Celsius)" and "Low". Different printing modes for printing on Sheet E (i.e., black paper) are specified with the setting used when the printing quality of the printing mode is not guaranteed. Accordingly, the image forming apparatus 1 according to the present example can perform image formation with a non-recommendable combination, that is, a setting other than the settings recommended according to the user's preference.

Figure 6A:
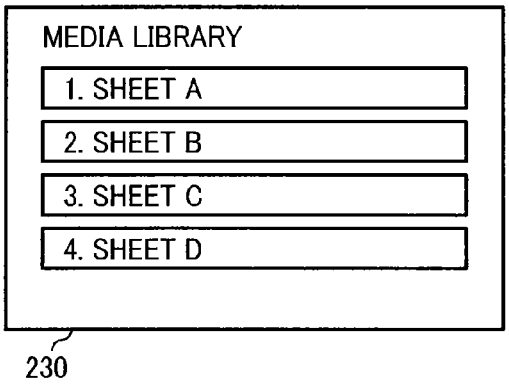
FIG. 6A is a diagram illustrating a display window of Media Library displaying selectable sheets in the image forming apparatus of FIG. 1.
Figure 6B:
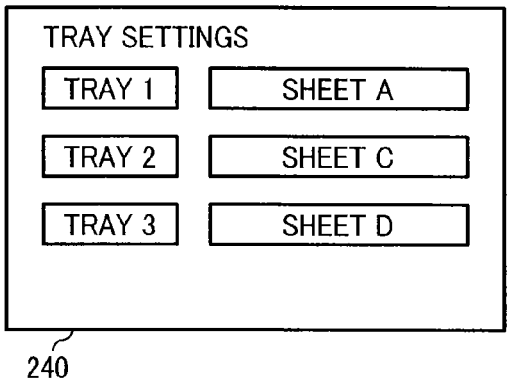
FIG. 6B is a diagram illustrating a display window of Tray Settings displaying selectable sheets in each sheet tray of the image forming apparatus of FIG. 1.
Figure 7:
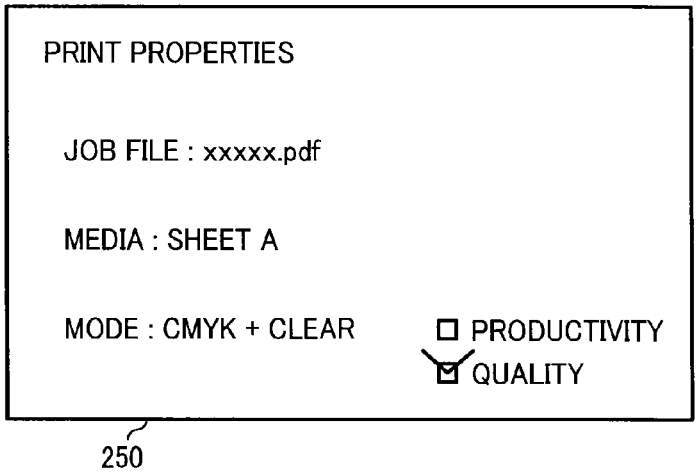
FIG. 7 is a diagram illustrating a display window of Print Properties displaying print setting in the image forming apparatus of FIG. 1.

A description is given of a flow of printing operations when using the sheet database, with reference to FIGS. 6A, 6B, and 7.

FIG. 6A is a diagram illustrating a display window of Media Library displaying selectable sheets in the image forming apparatus 1, FIG. 6B is a diagram illustrating a display window of Tray Settings displaying selectable sheets in each sheet tray of the image forming apparatus 1, and FIG. 7 is a diagram illustrating a display window of Print Properties displaying print setting in the image forming apparatus 1.

A user selects a sheet brand of a sheet to be used for the print job from a sheet list 230 indicated as "Media Library" (FIG. 6A), which is stored in the sheet database 310, and then load a single sheet or a bundle of sheets of the selected sheet brand into a sheet container (e.g., the sheet container 131) of the sheet feeding device 13. With the selected sheet loaded in the sheet container of the sheet feeding device 13, the user specifies a sheet type of the sheet(s) via a selection window 240 as illustrated in FIG. 6B. At this time, the display panel 171 of the display control unit 17 displays a display window of selectable sheets in each tray of the image forming apparatus 1, as illustrated in FIG. 6B.

The sheet type accommodated in each sheet tray is specified via the selection window 240. A desired sheet can be specified via a pull down menu, for example. As illustrated in FIG. 6B, for example, the selection window 240 shows that "Sheet A" is accommodated in Tray 1, "Sheet C" is accommodated in Tray 2, and "Sheet D" is accommodated in Tray 3. Thereafter, when the print job is performed using the sheet in any one of these sheet trays, a setting value specified based on the sheet database 310 is applied.

When performing the print job, the user selects the sheet brand and the printing mode via a print setting window 250 displayed on the display panel 171. By so doing, the database retrieving unit 320 makes reference to the optimum setting value stored in the sheet database 310 and specifies the optimum setting value. The print setting window 250 displays a printing file (Job File), a sheet brand (Job File), a sheet type (Media), and a printing mode (Mode).

Here, different conditions are applied according to the settings with the printing modes with color toner combinations including special color toner(s). Specifically, the conditions using special color toner(s) are different based on a total amount of toner on the sheet. In the CMYK printing mode, which is generally used with the regular color toners, the controller 10 controls the image processing so that the total amount of toner on the sheet does not exceed an upper limit of a given total amount of toner on the sheet. However, when the special color toner is used in the "CMYK+Clear" printing mode, for example, the productivity of printed sheets is sacrificed in favor of gloss, and the controller 10 controls to increase the upper limit of total toner amount on a sheet.

However, some users preferably reduces a decorative effect of the special color toner to a minimum requirement in favor of productivity.

In order to eliminate the inconvenience, when the image forming apparatus 1 performs image formation with a printing mode using both the regular color toners and the special color toner, the operation setting unit 340 employs the same setting as the setting for image formation performing with a printing mode using the regular color toners without any special color toner. In this case, the printing mode generally falls on "CMYK and special color toner". However, by setting the total amount of toner on the sheet equal to the total amount of toner in the CMYK printing mode, another printing mode (a productivity priority mode) having the same setting as the CMYK printing mode is temporarily provided. This temporary printing mode can be selected via the print properties setting window displayed before printing.

Further, when a combination of sheet and the regular color toner plus the special color toner, which is not previously assumable, is selected, the operation setting unit 340 can provide a setting that can convey the sheet without stopping the image forming operation. This operation can also be performed when a non-recommendable combination of sheet and the regular color toner and the special color toner is selected. Due to these settings, regardless of the type of special color toner, the same sheet database can be applied to an image forming apparatus (e.g., the image forming apparatus 1) in which any other printing mode can be set.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. An image forming apparatus comprising:

an image formation processor to perform image formation to a recording medium with a primary color toner and a secondary color toner that is different from the primary color toner;

a database to store multiple setting values, each of which corresponding to a combination of a mode type depending on the primary color toner and the secondary color toner and a media type of the recording medium and being applied to a process of the image formation performed by the image formation processor;

a database retriever to retrieve an optimum setting value from the multiple setting values stored in the database according to a specified combination of the mode type and the media type;

an operation setting arranger to perform the image formation based on the optimum setting value acquired from the database retriever; and a warning generator to issue a warning message, wherein the database stores a non-recommendable combination of the media type and the mode type with the secondary color toner, wherein the warning generator issues the warning message on selection of the non-recommendable combination, and wherein when the warning generator issues the warning message and when either one of a non-assumable combination of the media type and the mode type with the primary color toner and the secondary color toner and a non-recommendable combination of the media type and the mode type with the primary color toner and the secondary color toner is selected, the operation setting arranger conveys the recording medium without stopping the image formation performed by the image formation processor.

2. The image forming apparatus according to claim 1, wherein the image formation processor includes at least one of an image forming device to form an image on an image bearer included therein, a transfer device to transfer the image formed on the image bearer of the image forming device onto the recording medium, and a fixing device to fix the image to the recording medium conveyed from the transfer device, wherein the process of the image formation processor includes respective processes performed by the at least one of the image forming device, the transfer device, and the fixing device, and wherein the database stores the multiple setting values applied to the respective processes.

3. The image forming apparatus according to claim 1, wherein the operation setting arranger sets an optional setting value other than the multiple setting values stored in the database.

4. The image forming apparatus according to claim 1, wherein the operation setting arranger temporarily sets a setting value used in the image formation with the primary color toner when performing the image formation with the primary color toner and the secondary color toner.

5. The image forming apparatus according to claim 1, further comprising:

an input device to receive an input from a user indicating that the printing of the non-recommendable combination is to occur, after the warning message has been issued.

6. A method for forming a color image comprising:

storing multiple setting values, each of which corresponding to a combination of a mode type depending on a primary color toner and a secondary color toner and a media type of a recording medium and being applied to a process of image formation to the recording medium;

retrieving an optimum setting value from the multiple setting values according to a specified combination of the mode type and the media type;

performing the image formation based on the optimum setting value acquired from the retrieving step;

storing a non-recommendable combination of the media type and the mode type; and issuing a warning message when the specified combination falls into a non-recommendable combination of the mode type and the media type; and performs a printing of the non-recommendable combination, after the warning message is issued because the specified combination falls into the non-recommendable combination.

7. The method according to claim 6, further comprising:

receiving an input indicating that the printing of the non-recommendable combination is to occur, after the warning message has been issued.

* * * * *